US011817635B2

(12) United States Patent
Wu

(10) Patent No.: US 11,817,635 B2
(45) Date of Patent: Nov. 14, 2023

(54) PHASE CONTROL DEVICE AND COMMUNICATION DEVICE

(71) Applicant: NEC Corporation, Tokyo (JP)

(72) Inventor: Mingqi Wu, Tokyo (JP)

(73) Assignee: NEC CORPORATION, Tokyo (JP)

( * ) Notice: Subject to any disclaimer, the term of this patent is extended or adjusted under 35 U.S.C. 154(b) by 217 days.

(21) Appl. No.: 17/418,449

(22) PCT Filed: Jan. 17, 2019

(86) PCT No.: PCT/JP2019/001164
§ 371 (c)(1),
(2) Date: Jun. 25, 2021

(87) PCT Pub. No.: WO2020/148843
PCT Pub. Date: Jul. 23, 2020

(65) Prior Publication Data
US 2022/0059942 A1 Feb. 24, 2022

(51) Int. Cl.
*H01Q 3/44* (2006.01)
*H01Q 3/46* (2006.01)

(52) U.S. Cl.
CPC ..... *H01Q 3/46* (2013.01)

(58) Field of Classification Search
CPC ..... H01Q 3/46; H01Q 3/44
See application file for complete search history.

(56) References Cited

U.S. PATENT DOCUMENTS 9,634,398 B2 * 4/2017 Liu ..... H01Q 19/062
2010/0220035 A1 * 9/2010 Lee ..... H01Q 15/02 343/909
2011/0148704 A1 6/2011 Kim
2015/0303584 A1 10/2015 Liu et al.
2021/0075119 A1 * 3/2021 Wu ..... H01Q 15/0086

FOREIGN PATENT DOCUMENTS

CN 105161858 A 12/2015
EP 2738874 A1 6/2014
JP 2007329422 A 12/2007
(Continued)

OTHER PUBLICATIONS

International Search Report for PCT Application No. PCT/JP2019/001164, dated Apr. 2, 2019.
(Continued)

*Primary Examiner* — Awat M Salih
(74) *Attorney, Agent, or Firm* — Sughrue Mion, PLLC

(57) ABSTRACT

A phase control device (100) includes a two-dimensional array of three-dimensional units (10) and is configured to control a phase of an electromagnetic wave passing through the three-dimensional units (10). Each three-dimensional unit (10) includes a substrate (12) and an active control layer (11). The active control layer (11) includes metal patches (111) and (112), and a modulator (113) disposed between the two metal patches and connected to each of the two metal patches. The substrate (12) includes at least one bias line (114 or 116) connected to one of the two metal patches and extending in a direction perpendicular to a direction of an electric field of the electromagnetic wave.

7 Claims, 11 Drawing Sheets

(56) References Cited

FOREIGN PATENT DOCUMENTS

| | | | |
|---|---|---|---|
| JP | 2015046846 | A | 3/2015 |
| JP | 2015231184 | A | 12/2015 |

OTHER PUBLICATIONS

Huang et al., "Asymmetric Transmission for Linearly Polarized Wave through Tunable Chiral Metasurface", 2018 Cross Strait Quad-Regional Radio Science and Wireless Technology Conference (CSQRWC), [online], Jul. 24, 2018, pp. 1-3, https://ieeexplore.ieee.org/document/8455259 [retrieved on Mar. 19, 2019].

* cited by examiner

PHASE CONTROL DEVICE AND COMMUNICATION DEVICE

TECHNICAL FIELD

The present disclosure relates to a phase control device and a communication device.

BACKGROUND ART

A technique for controlling propagation characteristics of electromagnetic waves by using a meta-material has been developed. The meta-material is, for example, a material in which a conductor and a dielectric have a periodic array structure. In an antenna device disclosed in Patent Literature 1, a plurality of reflectors made of a meta-material allow only an electromagnetic wave belonging to a specific frequency band, which is determined based on a lattice-like periodic array pattern of at least one of a dielectric or a conductor, to pass therethrough and reflect the electromagnetic wave in other frequency bands.

Meanwhile, it has been desired to develop a technique for actively changing propagation characteristics of electromagnetic waves in an antenna device using a meta-material. For example, in an electromagnetic-field sensitive functional material disclosed in Patent Literature 2, each unit cell is formed by printing a square conductor circuit on a substrate and inserting a PIN diode as a circuit element at the center of each side of the conductor circuit.

CITATION LIST

Patent Literature

PTL 1: Japanese Unexamined Patent Application Publication No. 2015-046846

PTL 2: Japanese Unexamined Patent Application Publication No. 2007-329422

SUMMARY OF INVENTION

Technical Problem

However, when the technique disclosed in Patent Literature 2 is applied to the antenna device disclosed in Patent Literature 1, it may be impossible to maintain desired efficiency. In particular, bias lines for controlling PIN diodes in the lattice-like periodic array pattern may lower propagation efficiency of the antenna device.

In view of the above-described problems, an example object of the present disclosure is to provide, for example, a phase control device that actively controls the phase of an electromagnetic wave while preventing or minimizing a decrease in efficiency.

Solution to Problem

In a first example aspect, a phase control device includes a two-dimensional array of three-dimensional units and is configured to control a phase of an electromagnetic wave passing through the three-dimensional units. Each three-dimensional unit includes a substrate and an active control layer. The active control layer includes two metal patches and a modulator disposed between the two metal patches and connected to each of the two metal patches. The substrate includes at least one bias line connected to one of the two metal patches and extending in a direction perpendicular to a direction of an electric field of the electromagnetic wave.

Advantageous Effects of Invention

According to the present disclosure, it is possible to provide, for example, a phase control device that actively controls the phase of an electromagnetic wave while preventing or minimizing a decrease in efficiency.

DESCRIPTION OF EMBODIMENTS

Figure 1:
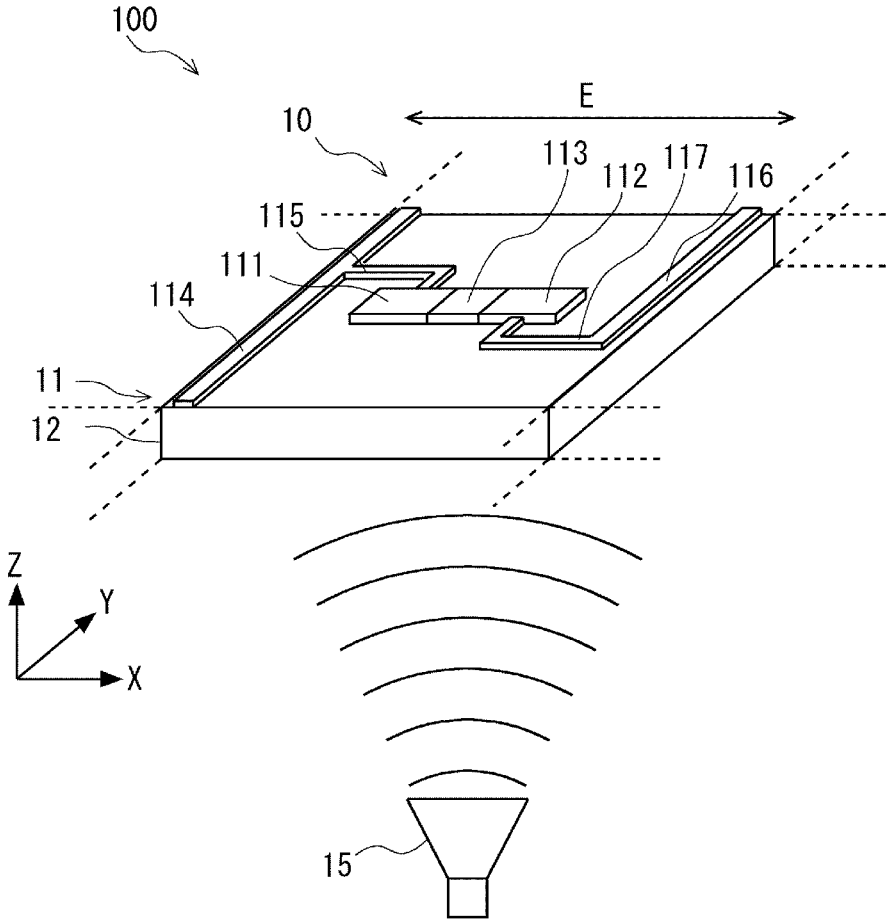
FIG. 1 illustrates a phase control device according to a first embodiment.

Embodiments of the present disclosure will be described below with reference to the drawings. In the drawings, the same elements are denoted by the same reference numerals, and thus a repeated description is omitted as needed.

First Embodiment

A phase control device according to a first embodiment will be described. FIG. 1 illustrates a phase control device 100 according to the first embodiment. For the sake of convenience for explaining the positional relationship among the constituent elements, a right-handed orthogonal coordinate system is shown in FIG. 1. In addition, in FIG. 2 and subsequent figures, when an orthogonal coordinate system is shown, the directions of the X, Y, and Z axes in these orthogonal coordinate systems coincide with the directions of the X, Y, and Z axes in FIG. 1.

The phase control device 100 according to the first embodiment is a phase control device that controls the phase of a linearly polarized wave. In the phase control device 100 according to the first embodiment, three-dimensional units 10 are two-dimensionally arranged on a plane parallel to the XY plane. The three-dimensional unit 10 shown in FIG. 1 shows one of the two-dimensionally arranged three-dimensional units 10. The principal surface of the phase control device 100 is parallel to the XY plane. The three-dimensional unit 10 has a quadrangular prism shape in which the shape of the bottom surface, which is coincident with the principal surface, is a square.

A size of the three-dimensional unit 10 is smaller than a wavelength of a target electromagnetic wave. Therefore, the array of the three-dimensional units 10 functions as an electromagnetically continuous medium or a meta-material. The refractive index of the array can be controlled independently of each other by controlling an equivalent permeability and an equivalent permittivity according to the configuration (or arrangement) of the three-dimensional units.

The three-dimensional unit 10 includes a substrate 12 and an active control layer 11. In the example shown in FIG. 1, the active control layer 11 is laid on the upper principal surface of the substrate 12.

The active control layer 11 includes at least a metal patch 111, a metal patch 112, and a diode 113. Each of the metal patches 111 and 112 is a metal piece having a predetermined size so as to function as a meta-material. One end of the metal patch 111 is connected to a bias line 114 via a conductive line 115, and the other end is connected to the diode 113. One end of the metal patch 112 is connected to a bias line 116 via a conductor 117, and the other end is connected to the diode 113.

Note that the metal patch 111 may be connected to the bias line 114 without the conductive line 115 interposed therebetween. Alternatively, it may be considered that the bias line 114 includes the conductive line 115 therein. Similarly, the metal patch 112 may be connected to the bias line 116 without the conductive line 117 interposed therebetween. Alternatively, it may be considered that the bias line 116 includes the conductor 117 therein. Therefore, in the following description, it may be described that the metal patch 111 is connected to the bias line 114. Likewise, the metal patch 112 may be described as being connected to the bias line 116.

The diode 113 is a modulator, and has such a function that when an electric signal including a predetermined voltage or a predetermined current is applied to the diode 113, it allows this electric signal to flow therethrough. The diode 113 in the present embodiment is a PIN diode including a P-type semiconductor, an N-type semiconductor, and an intrinsic semiconductor interposed therebetween. One end of the diode 113 at which the N-type semiconductor is located is connected to the metal patch 111, and the other end at which the P-type semiconductor is located is connected to the metal patch 112.

A bias line 114 and a bias line 116 are provided in the active control layer 11 laid on the substrate. The bias line 114 is a conductive wire and is connected to the metal patch 111 via a conductive line 115. Likewise, the bias line 116 is a conductor and is connected to the metal patch 112 via a conductor 117.

Further, as shown in FIG. 1, the bias lines 114 and 116 extend in a direction parallel to the Y axis. A direction E indicated by an arrow indicates the direction of the electric field of an electromagnetic wave passing through the phase control device 100. The direction E is parallel to the X axis. That is, the phase control device 100 includes the bias lines 114 and 116 extending perpendicularly to the direction E of the electric field of the electromagnetic wave transmitted by a linearly-polarized antenna.

The bias lines 114 and 116 are connected to a circuit for controlling the phase control device 100. More specifically, the bias line 114 is connected to the ground and the bias line 116 is connected to a switch circuit which changes the value of a current applied to the bias line 116. That is, when a current larger than a predetermined value is supplied from the switch circuit, the diode 113 is switched from an Off state to an On state. In addition, when a current larger than the predetermined value is not supplied from the switch circuit, the diode 113 is turned to the Off state. The alteration of the state enables the three-dimensional unit 10 to change the impedance, which decides the equivalent permeability and the permittivity. Thereby, the phase control device 100 can actively change the phase of the electromagnetic wave passing through the phase control device 100.

Figure 2:
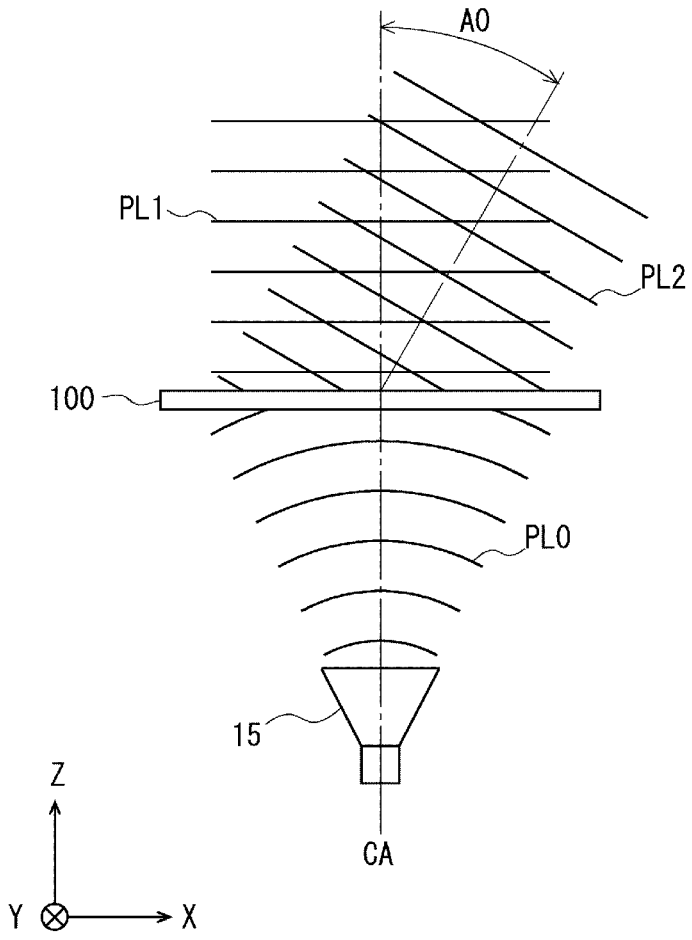
FIG. 2 illustrates a side view of the phase control device according to the first embodiment.
Figure 3:
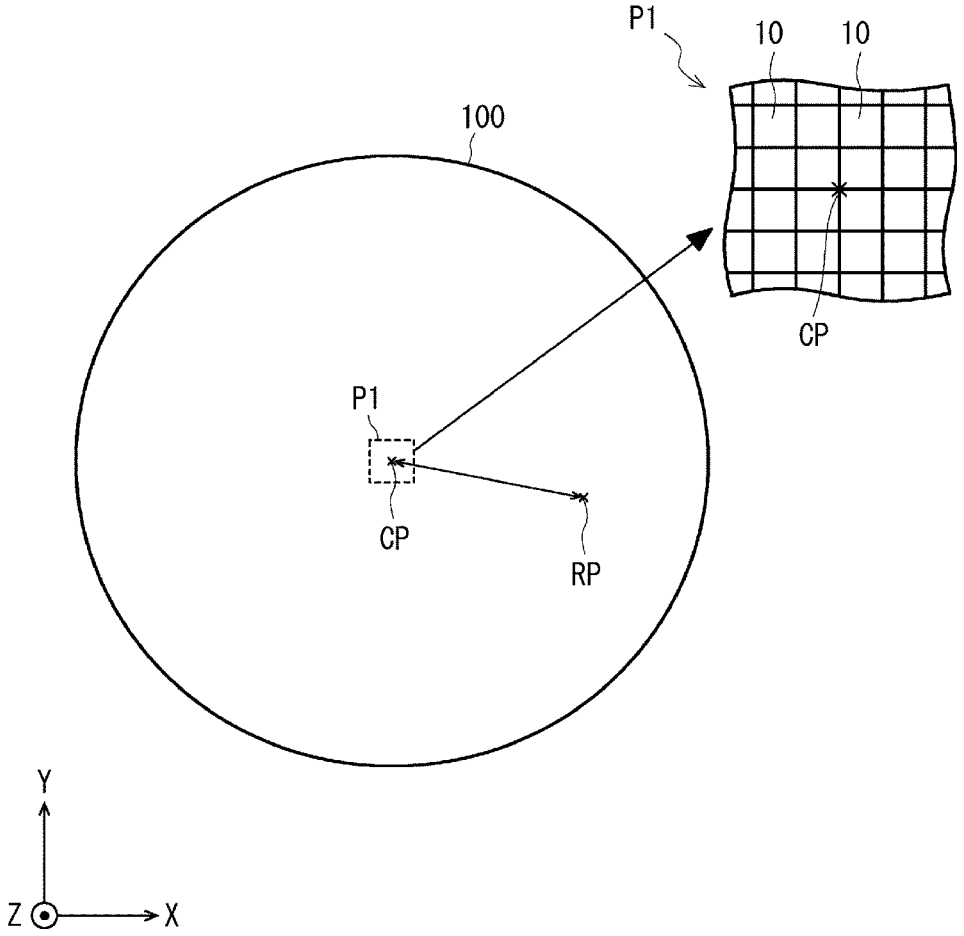
FIG. 3 illustrates a plan view of the phase control device according to the first embodiment.

The phase control device 100 will be further described with reference to FIGS. 2 and 3. FIG. 2 illustrates a side view of the phase control device 100 according to the first embodiment. FIG. 3 illustrates a plan view of the phase control device 100 according to the first embodiment. In FIG. 2, a central axis of the phase control device 100 is represented by a line CA. In FIG. 3, a center point of the phase control device 100 on the XY plane positioned on the central axis CA is represented by CP. As shown in FIG. 3, the phase control device 100 has a disk-like shape. Further, as shown in an enlarged part P1 in FIG. 3, the phase control device 100 includes a plurality of three-dimensional units 10 two-dimensionally arranged in a matrix (i.e., in an array) on a plane parallel to the XY plane.

As illustrated FIGS. 2 and 3, one surface of the phase control device 100 faces an antenna 15. That is, the phase control device 100 and the antenna 15 constitute an antenna system. In this case, a transmission direction of the electromagnetic wave is the Z-axis direction. The phase control device 100 is configured to control a phase of the electromagnetic wave emitted from the antenna 15 while the electromagnetic wave is passing through the phase control device 100. Further, the phase control device 100 changes the phase to be controlled according to the signal received from the above-mentioned switch circuit. Note that the switch circuit can provide different signals to each of the three-dimensional unit 10. The switch circuit has predetermined number of "control pattern set", being set to provide predetermined signal to the three-dimensional units 10 respectfully. The control pattern set can decide the overall characteristics of the phase control device 100. Thus, the phase control device 100 has a number of such control pattern sets so as to focus beam of an electromagnetic wave at different angle by providing different control pattern set to the phase control device 100. That is, the phase control device 100 can change the phase form of the electromagnetic wave which is set by changing the state form of the three-dimensional units 10.

When the antenna 15 is not a directional antenna, the antenna 15 isotropically emits electromagnetic waves. Various types of antennas such as a horn antenna, a dipole antenna, and a patch antenna can be used as the antenna 15. Therefore, when an electromagnetic wave reaches the surface of the phase control device 100 facing the antenna 15, the phase of the electromagnetic wave is not uniform on this surface of the phase control device 100. In FIG. 2, curved lines PL0 schematically indicate a plane of the equal phase of an electromagnetic wave radiated from the antenna 15. As illustrated in FIG. 2, on the surface of the phase control device 100 facing the antenna 15, the farther from the center point CP, the more the phase of the electromagnetic wave is delayed. That is, the amount of the delay increases as the distance from the central point CP increases.

As illustrated in FIG. 3, a reference point located at the center of each three-dimensional unit in the XY plane is indicated by RP. Note that, for simplification, the reference point RP of only one three-dimensional unit is illustrated in FIG. 3. In this case, as described above, as the distance L from the center point CP to the reference point RP increases, the delay of the phase of the electromagnetic wave, which is transmitted from the antenna 15 and reaches the three-dimensional unit, increases.

In the example of the embodiment herein, the phase control device 100 is configured so that in a particular control pattern set, the phase delay amount of the three-dimensional units 10 decreases as the distance L from the center point CP to the reference point RP increases in order to make the phase plane of the electromagnetic wave emitted from the part of the surface of the phase control unit 100 that does not face the antenna 15 (i.e., that faces areas surrounding the antenna 15) equal to XY plane. Accordingly, the phase control device 100 focuses the electromagnetic wave emitted from the antenna like a convex lens. Here, the above control pattern set, which set the states of all the three-dimensional units 10 in a particular rule that makes the emitted phase plane of the electromagnetic wave being parallel to XY plane, is called pattern 0.

Thus, in the pattern 0, the phase control device 100 controls the phase of the electromagnetic wave so as to emit an electromagnetic wave having a phase plane perpendicular to the transmission direction. In other words, the phase plane of the electromagnetic wave radiated from the phase control device 100 in the pattern 0 is the XY plane perpendicular to the Z-axis direction.

Further, in another control pattern set which is indicated in FIG. 2, the phase control device 100 controls the phase of the electromagnetic wave so as to emit an electromagnetic wave having a phase plane perpendicular to a line inclined from the transmission direction by an angle A0. The control pattern set the phase plane perpendicular to the line inclined from the transmission direction by the angle A0 is here called pattern 1. The phase plane in the state of pattern 1 is a plane inclined from the XY plane by the angle A0.

In FIG. 2, straight lines PL1 parallel to the XY plane schematically indicates a plane of the equal phase of the electromagnetic wave that was emitted from the antenna 15 and has passed through the phase control device 100. Further, in FIG. 2, straight lines PL2 inclined from the XY plane by an angle A0 schematically indicate a plane of the equal phase of the electromagnetic wave that was emitted from the antenna 15 and has passed through the phase control device 100.

As described above, the phase control device 100 according to the embodiment can change how the phase of the electromagnetic wave emitted from the antenna 15 is controlled by using the different pattern of the signal set applying to the diodes. Therefore, the phase control device 100 can control the emitting direction of the electromagnetic wave by controlling the phase of the electromagnetic wave emitted from the antenna 15. It should be noted that how the phase is controlled is not limited to the example shown above. That is, the phase control device 100 may control the phase of the electromagnetic wave of the linearly polarized wave so that the phase (i.e., the plane of the equal phase) becomes parallel to an arbitrary plane, or so that the phase (i.e., the plane of the equal phase) conforms to an arbitrary curved plane.

Figure 4:
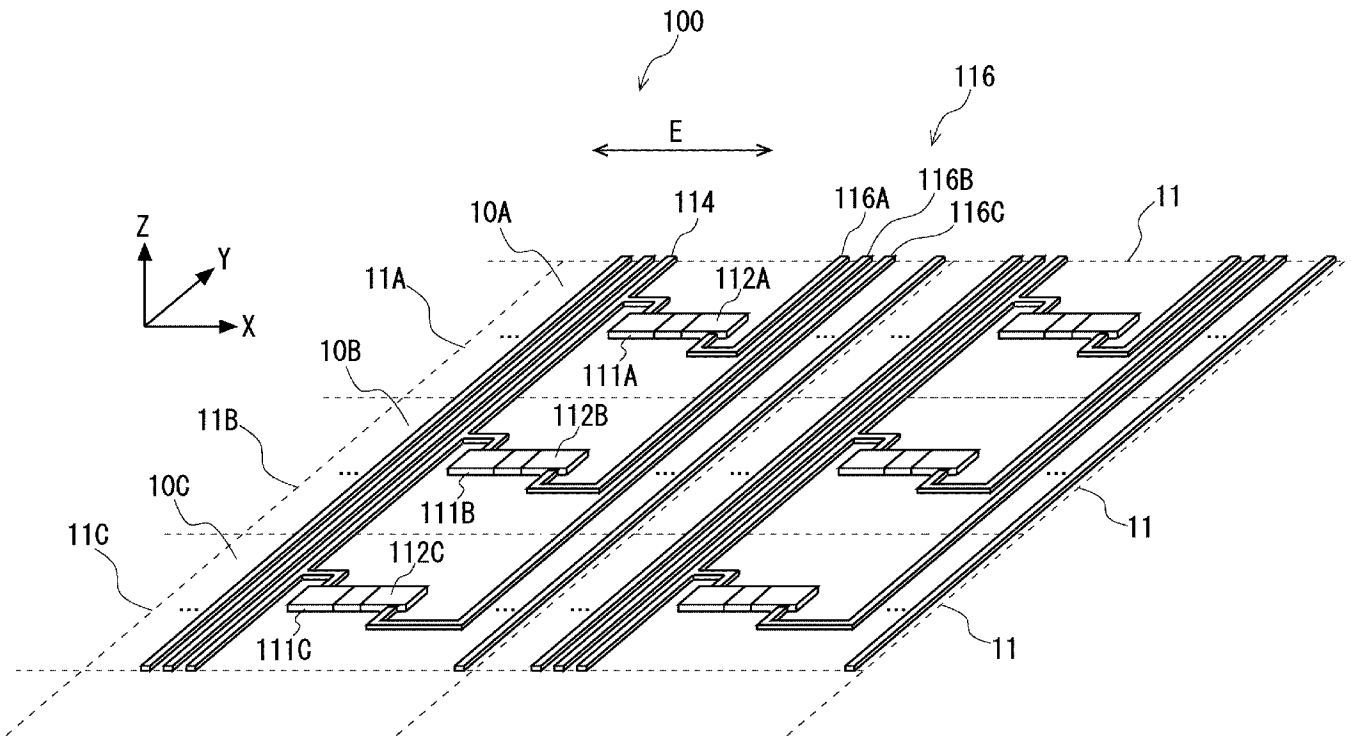
FIG. 4 illustrates a part of the phase control device.

Next, a configuration of bias lines is described with reference to FIG. 4. FIG. 4 illustrates a part of the active control layer 11 two-dimensionally arranged in the phase control device 100. The phase control device 100 includes a plurality of three-dimensional units 10. The three-dimensional units 10 are arranged in a matrix pattern in the XY plane. Therefore, as shown in FIG. 4, a plurality of active control layers 11 are two-dimensionally arranged on the same plane. In FIG. 4, an arrow E parallel to the X axis indicates the direction of the electric field of the electromagnetic wave radiated from the antenna.

Further, among the three-dimensional units 10 shown in FIG. 4, three three-dimensional units located in the left column are denoted by symbols 10A, 10B and 10C from the Y-axis positive side to the Y-axis negative side. Similarly, a suffix A is added to each of symbols assigned to components included in the three-dimensional unit 10A. For example, as shown in FIG. 4, the three-dimensional unit 10A includes an active control layer 11A. Further, the active control layer 11A includes a metal patch 111A and a metal patch 112A. Further, the active control layer 11A includes a bias line 116A connected to the metal patch 112A. Similarly, a suffix B is added to each of symbols assigned to components included in the three-dimensional unit 10B and a suffix C is added to each of symbols assigned to components included in the three-dimensional unit 10C.

In FIG. 4, the metal patch 111A included in the three-dimensional unit 10A is connected to a bias line 114. Further, the metal patch 111B included in the three-dimensional unit 10B is also connected to the bias line 114. Similarly, the metal patch 111C included in the three-dimensional unit 10C is also connected to the bias line 114. That is, the metal patches 111A to 111C arranged in parallel to the Y axis are connected to the bias line 114, which serves as the common ground. Therefore, the bias line 114 extends perpendicularly to the direction of the electric field of the electromagnetic wave and is connected to a plurality of metal patches 111 as the common ground. By the above-described configuration, the phase control device 100 prevents an increase in the number of bias lines.

Next, the metal patch 112A included in the three-dimensional unit 10A is connected to a bias line 116A. One end of the bias line 116A is connected to the metal patch 112A and the other end of the bias line 116A extends in the Y-axis positive direction. Further, the metal patch 112B included in the three-dimensional unit 10B is connected to a bias line 116B. One end of the bias line 116B is connected to the metal patch 112B, and the other end of the bias line 116B extends in the Y-axis positive direction and passes through the active control layer 11A. Similarly, the metal patch 112C included in the three-dimensional unit 10C is connected to a bias line 116C. One end of the bias line 116C is connected to the metal patch 112C, and the other end of the bias line 116C extends in the Y axis positive direction and passes through the active control layers 11B and 11A. As described above, a plurality of bias lines 116 extend perpendicularly to the direction of the electric field of the electromagnetic wave. Further, the active control layer 11 includes bias lines 116 extending from other three-dimensional units 10 arranged in a matrix pattern.

Although the first embodiment has been described above, the shape of the three-dimensional unit 10 is not limited to the quadrangular prism. As long as the three-dimensional units 10 can be densely arranged in a two dimensional array, other shapes such as a cuboid (a rectangular parallelepiped) and a hexagonal column can be adopted as the shape of the three-dimensional unit 10. Further, the phase control device 100 may not have only the round shape but other shape such as a rectangular shape, or hexagonal shape.

Further, the active control layer 11 may be laid (i.e., disposed) on the principal surface on the lower side of the substrate 12, or may be laid (i.e., disposed) in an intermediate layer of the substrate 12. The diode 113 may not be the PIN diode, but may be a varactor whose capacitance changes according to a voltage applied to a terminal thereof.

By the above-described configuration, the phase control device 100 according to this embodiment changes characteristics of the three-dimensional units arranged in a matrix pattern (i.e., arranged in an array) while preventing a decrease in propagation efficiency of electromagnetic waves. Therefore, according to the first embodiment, it is possible to provide a phase control device that actively controls the phase of an electromagnetic wave while preventing a decrease in efficiency.

Second Embodiment

Figure 5:
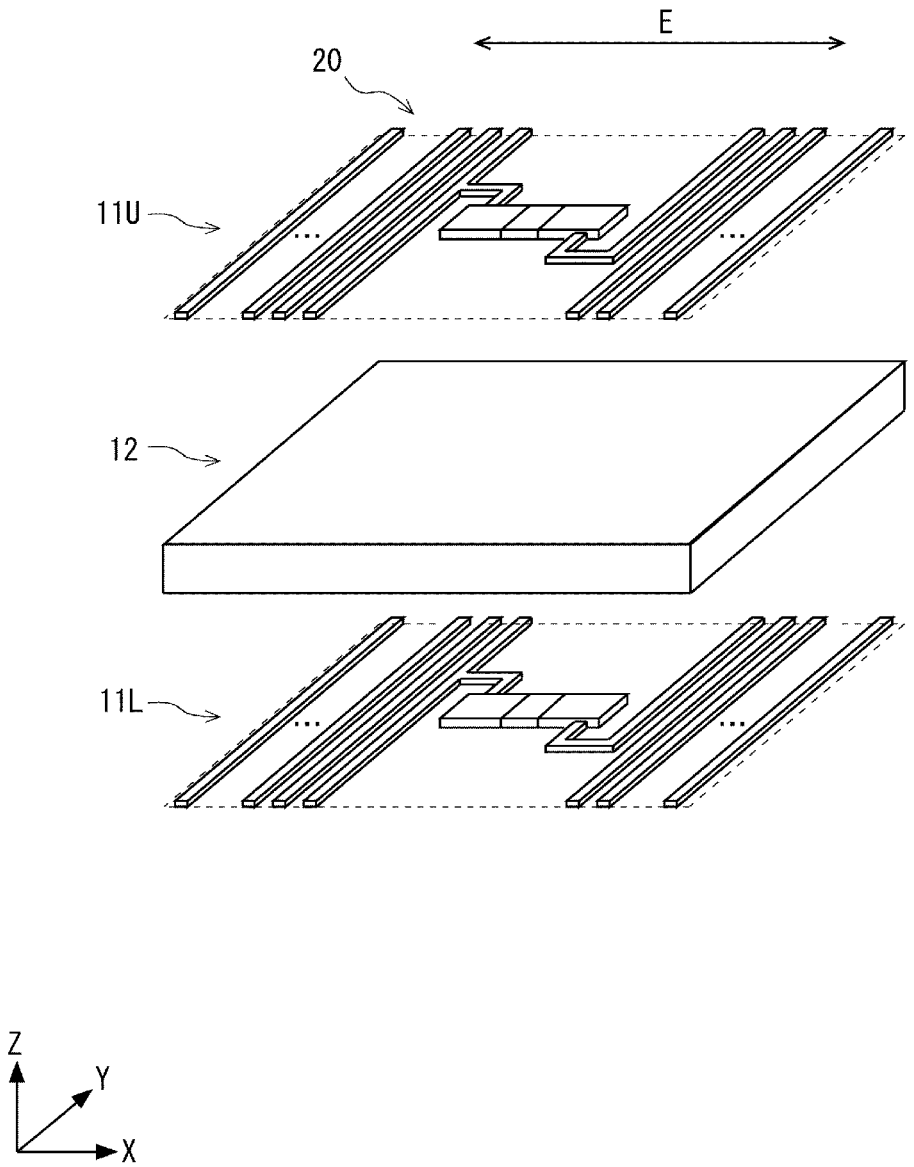
FIG. 5 illustrates an example of a three dimensional unit according to a second embodiment.

Next, a second embodiment is described with reference to FIG. 5. FIG. 5 shows an example of a three-dimensional unit according to the second embodiment. A phase control device 100 according to the second embodiment differs from the phase control device 100 according to the first embodiment because the phase control device 100 according to the second embodiment includes three-dimensional units 20 in place of the three-dimensional units 10. The embodiment is described hereinafter. However, explanations of components/structures that have already been described in the above-described example are omitted as appropriate.

Each of the three-dimensional units 20 included in the phase control device 100 according to this embodiment includes an active control layer 11 disposed on each of the principal surfaces on the front and back sides (or the upper and lower sides) of the substrate 12. That is, the three-dimensional unit 20 includes an active control layer 11U disposed on the upper side of the substrate 12 and an active control layer 11L disposed on the lower side of the substrate 12. Note that for the sake of easier understanding, the three-dimensional unit shown in FIG. 5 is shown in a state where its layers are separated from each other in the stacking direction.

Further, as shown in FIG. 5, the three-dimensional unit 20 includes an active control layer 11 disposed on each of the principal surfaces on the front and back sides of the substrate 12 in such a manner that they overlap each other (i.e., are aligned with each other) in an orthogonal direction orthogonal to the principal surfaces of the substrate 12 (i.e., in the Z-axis direction). By the above-described configuration, the phase control device 100 can control the phase of an electromagnetic wave radiated from the antenna 15 over a range of 0 to 180 degrees. That is, one three-dimensional unit 20 can change the phase of an electromagnetic wave received from the antenna 15 over the range of 0 to 180 degrees.

Note that each of the active control layers 11U and 11L includes a plurality of bias lines. Each of the plurality of bias lines included in the active control layers 11U and 11L extends in a direction perpendicular to a direction E, which is the direction of the electric field of the electromagnetic wave (i.e., in the Y-axis direction).

Modified Example of Second Embodiment

Figure 6:
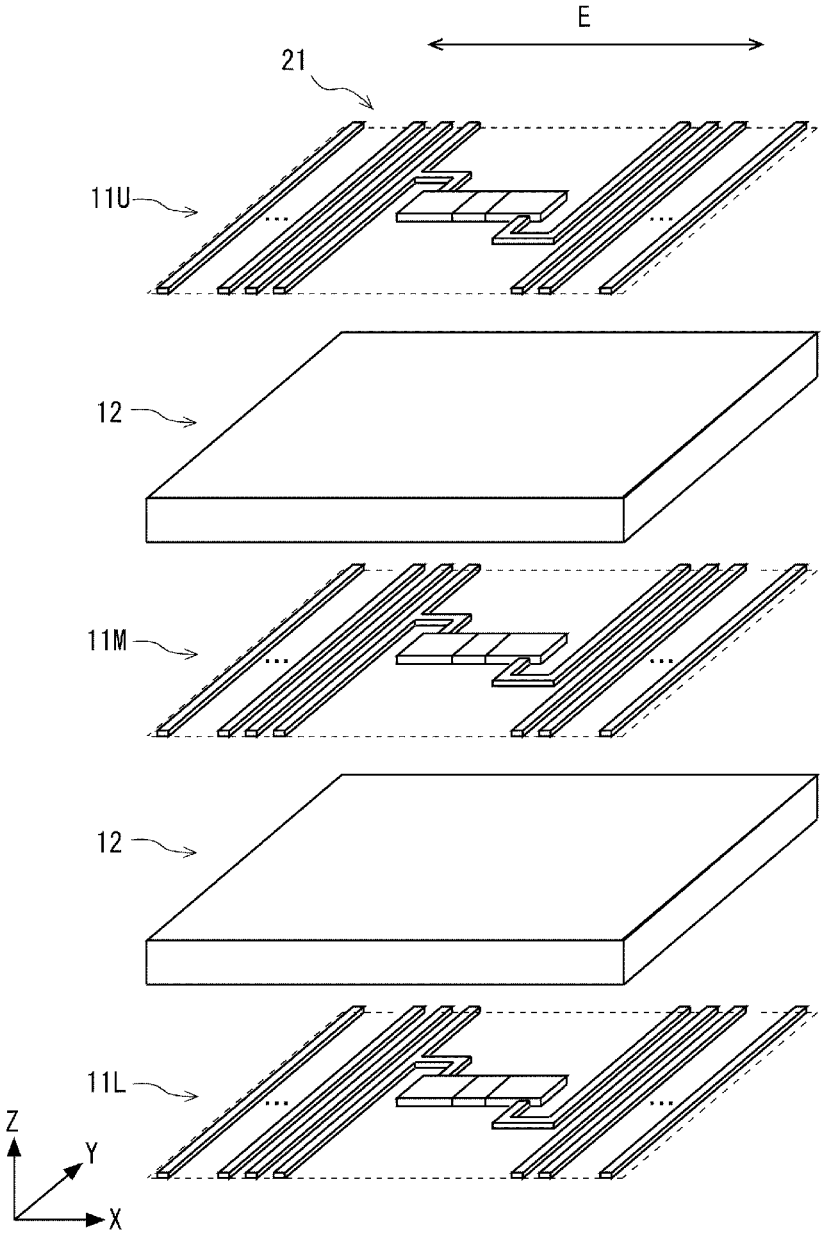
FIG. 6 illustrates an example of a three dimensional unit according to a modified example of the second embodiment.

Next, a modified example of the second embodiment is described with reference to FIG. 6. FIG. 6 shows an example of a three-dimensional unit according to the modified example of the second embodiment. Each of three-dimensional units 21 included in a phase control device 100 according to the modified example of this embodiment further includes at least one active control layer in an intermediate layer of the substrate.

As shown in FIG. 6, the three-dimensional unit 21 includes two substrate layers 12. Further, the three-dimensional unit 21 includes an active control layer 11M in an intermediate layer disposed between the upper and lower substrates 12. An active control layer 11U and an active control layer 11L disposed on the principal surfaces of the substrates, and the active control layer 11M disposed in the intermediate layer are arranged so as to overlap each other (i.e., to be aligned with each other) in the orthogonal direction (the Z-axis direction). By the above-described configuration, the phase control device 100 can control the phase of an electromagnetic wave radiated from the antenna 15 over a range of 0 to 360 degrees. That is, one three-dimensional unit 20 can change the phase of an electromagnetic wave received from the antenna 15 over the range of 0 to 360 degrees.

By the above-described configuration, the phase control device 100 according to this embodiment can provide a phase control device capable of actively controlling the phase of an electromagnetic wave while preventing a decrease in efficiency.

Third Embodiment

Figure 7:
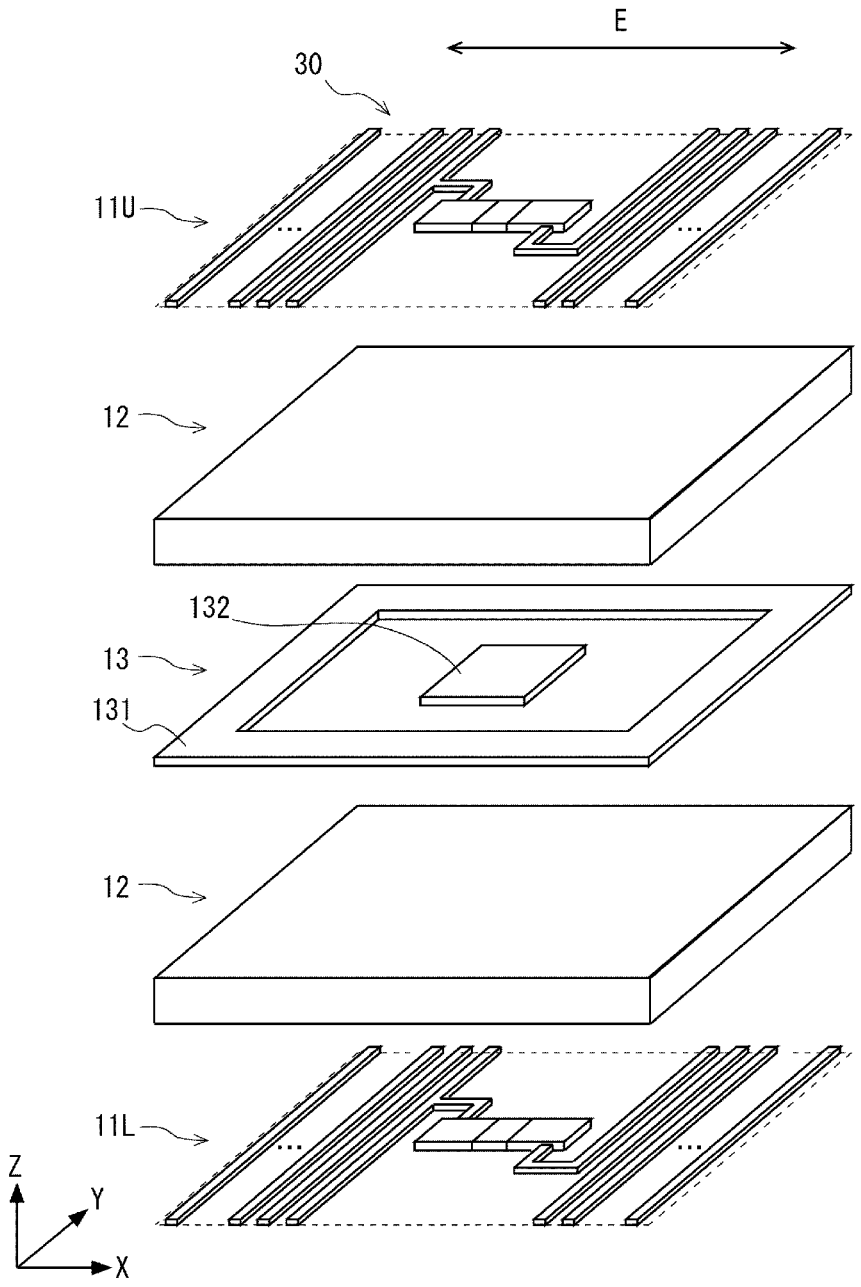
FIG. 7 illustrates an example of a three dimensional unit according to a third embodiment.

Next, a third embodiment is described with reference to FIG. 7. FIG. 7 shows an example of a three-dimensional unit according to the third embodiment. A phase control device 100 according to the third embodiment differs from the phase control device 100 according to the first embodiment because the phase control device 100 according to the third embodiment includes three-dimensional units 30 in place of the three-dimensional units 10. The embodiment is described hereinafter. However, explanations of components/structures that have already been described in the above-described example are omitted as appropriate. Note that for the sake of easier understanding, the three-dimensional unit shown in FIG. 5 is shown in a state where its layers are separated from each other in the stacking direction.

The three-dimensional unit 30 shown in FIG. 7 includes an active control layer 11U, an active control layer 11L, substrates 12, and a passive control layer 13. Further, in the configuration, the active control layer 11U, one of the substrates 12, the passive control layer 13, the other substrate 12, and the active control layer 11L are stacked on one after another in this order from the Z-axis positive side toward the Z-axis negative side in the orthogonal direction orthogonal to the principal surfaces of the substrates 12 (i.e., in the Z-axis direction). That is, the three-dimensional unit 30 includes the passive control layer 13 in an intermediate layer of the substrates 12, i.e., an intermediate layer located between the two substrates 12.

The passive control layer 13 includes, as its structure, a metal frame 131 and a metal patch 132. The metal frame 131 is a flat metal conductor including an opening formed therein. As shown in FIG. 7, the metal frame 131 in this embodiment has a hollow rectangular shape (i.e., a rectangular frame shape) and extends along the outer edge of the principal surfaces of the three-dimensional unit 30. The metal patch 132 is a flat metal conductor that is disposed in the opening of the metal frame 131 so that the metal patch 132 is surrounded by the metal frame 131.

A part of the substrate 12 or an air layer, which is dielectric, is interposed between the metal frame 131 and the metal patch 132 of the passive control layer 13. By the above-described configuration, the passive control layer 13 can produces a predetermined change in the phase of an electromagnetic wave radiated from the antenna 15.

Note that the form of the passive control layer 13, i.e., the size and/or the shape of the metal frame 131 and/or the metal patch 132 may be changed for each of the two-dimensionally arranged three-dimensional units. By changing the form of the passive control layer 13 for each of the two-dimensionally arranged three-dimensional units, the phase control device 100 can determine beforehand how the phase of the electromagnetic wave is controlled in an Off state.

The active control layer 11 and the passive control layer 13 in this embodiment are disposed so as to overlap each other (i.e., to be aligned with each other) in the Z-axis direction. Note that in this embodiment, the phase control device 100 may include a plurality of passive control layers 13 disposed in intermediate layers between the substrates 12. In that case, the phase control device 100 includes the passive control layers 13 so as to overlap each other (i.e., to be aligned with each other) in the Z-axis direction.

Note that each of the active control layers 11U and 11L includes a plurality of bias lines. Each of the plurality of bias lines included in the active control layers 11U and 11L extends in a direction perpendicular to a direction E, which is the direction of the electric field of the electromagnetic wave (i.e., in the Y-axis direction).

By the above-described configuration, the phase control device 100 according to this embodiment can provide a phase control device capable of controlling the phase of an electromagnetic wave in the Off state and actively controlling the phase in the On state while preventing a decrease in efficiency.

Fourth Embodiment

Next, a fourth embodiment is described with reference to FIG. 8. A phase control device 100 according to the fourth embodiment differs from the phase control device 100 according to the first embodiment because the phase control device 100 according to the fourth embodiment includes three-dimensional units 40 in place of the three-dimensional units 10. The embodiment is described hereinafter. However, explanations of components/structures that have already been described in the above-described example are omitted as appropriate. Note that for the sake of easier understanding, the three-dimensional unit shown in FIG. 8 is shown in a state where its layers are separated from each other in the stacking direction.

Figure 8:
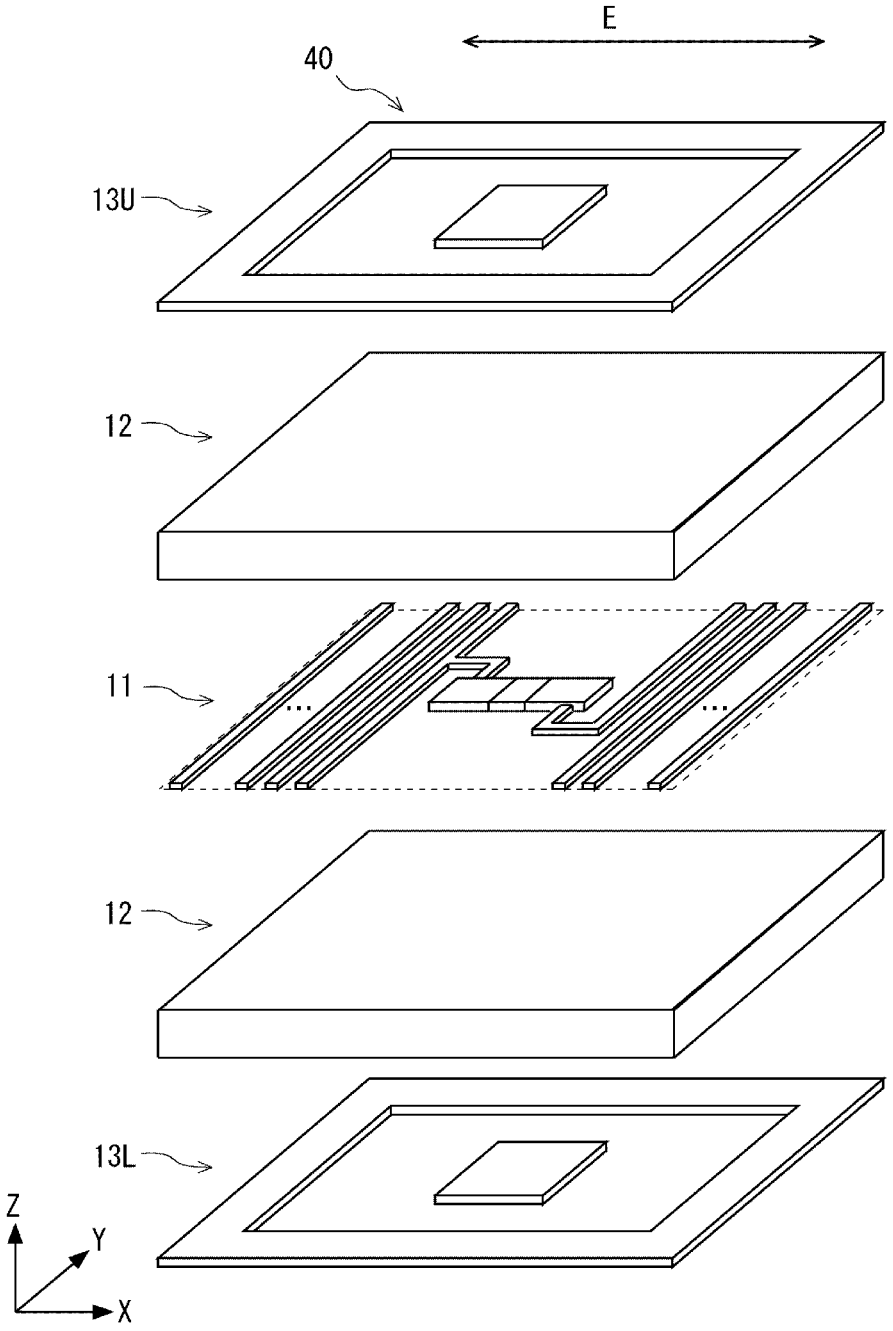
FIG. 8 illustrates an example of a three dimensional unit according to a fourth embodiment.

FIG. 8 shows an example of a three-dimensional unit according to the fourth embodiment. The three-dimensional unit 40 shown in FIG. 8 includes an active control layer 11, substrates 12, a passive control layer 13U, and a passive control layer 13L. Further, in the configuration, the passive control layer 13U, one of the substrates 12, the active control layer 11, the other substrate 12, and the passive control layer 13L are stacked on one after another in this order from the Z-axis positive side toward the Z-axis negative side in the orthogonal direction orthogonal to the principal surfaces of the substrates 12 (or in the Z-axis direction). That is, the three-dimensional unit 30 includes the active control layer 11 in an intermediate layer of the substrates 12, i.e., an intermediate layer located between the two substrates 12. Further, the three-dimensional unit 30 includes the passive control layer 13U on the principal surface on the front side (hereinafter referred to as the front principal surface) of the upper substrate 12 and the passive control layer 13L on the principal surface on the back side (hereinafter referred to as the back principal surface) of the lower substrate 12.

Note that each of a plurality of bias lines included in the active control layer 11 extends in a direction perpendicular to a direction E, which is the direction of the electric field of the electromagnetic wave (i.e., in the Y-axis direction).

The passive control layers 13U and 13L and the active control layer 11 are disposed so as to overlap each other (i.e., to be aligned with each other) in the orthogonal direction orthogonal to the principal surfaces. By the above-described configuration, the phase control device 100 according to this embodiment can provide a phase control device capable of controlling the phase of an electromagnetic wave in the Off state and actively controlling the phase in the On state while preventing a decrease in efficiency.

Modified Example of Fourth Embodiment

Figure 9:
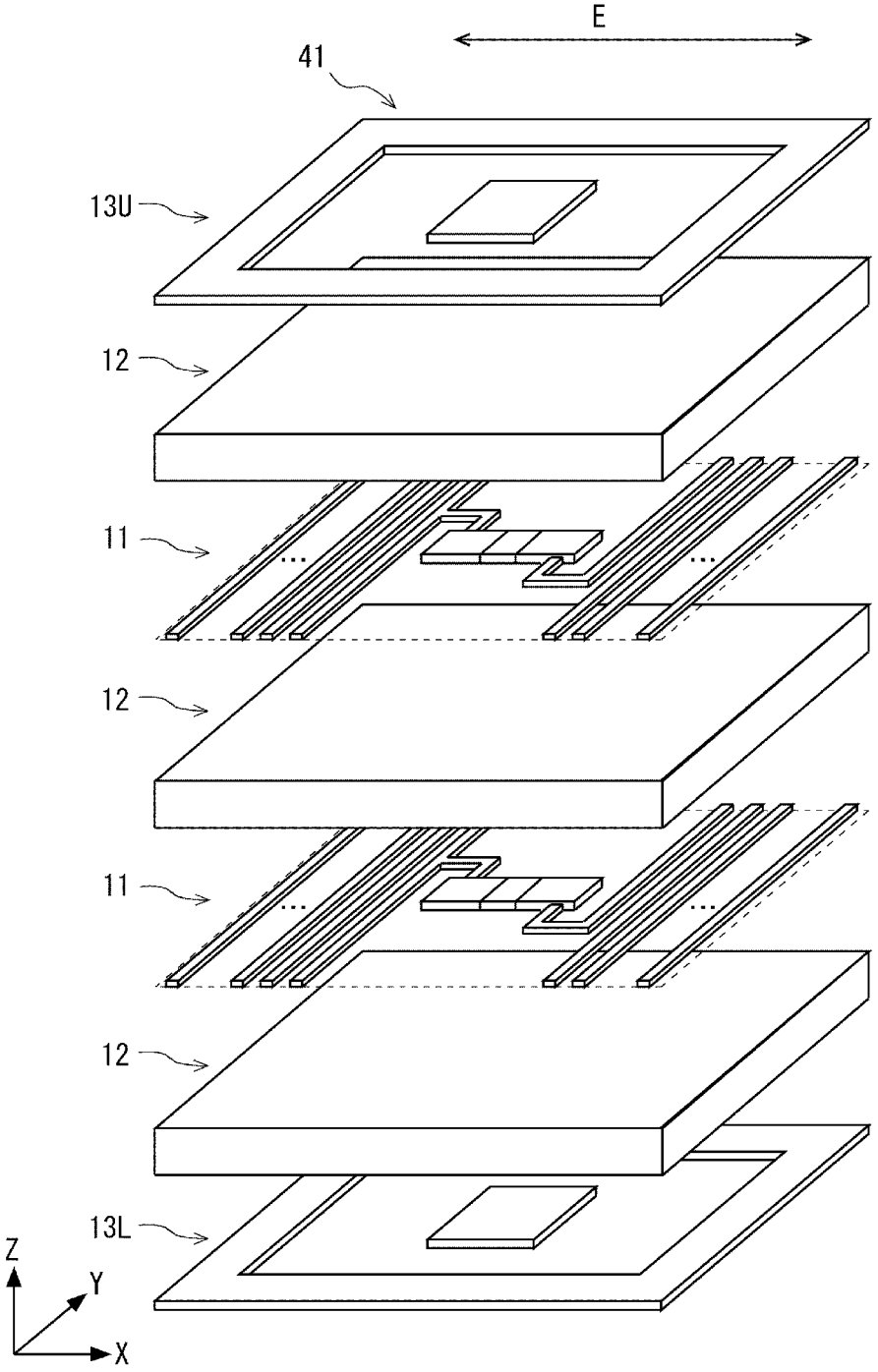
FIG. 9 illustrates an example of a three dimensional unit of a modified example of the fourth embodiment.

Next, a modified example of the fourth embodiment is described with reference to FIG. 9. FIG. 9 shows an example of a three-dimensional unit according to the modified example of the fourth embodiment. Each of three-dimensional units 31 included in a phase control device 100 according to the modified example of this embodiment further includes at least one active control layer in an intermediate layer of the substrate.

As shown in FIG. 9, the three-dimensional unit 31 includes three substrate layers 12. Further, the three-dimensional unit 31 includes an active control layer 11 between an upper substrate 12 and an intermediate substrate 12, and includes another active control layer 11 between the intermediate substrate 12 and a lower substrate 12. That is, it can be considered that the three-dimensional unit 31 includes two active control layers 11 in the intermediate layers of the substrates 12. Note that three or more active control layers 11 may be provided in the intermediate layers of the substrates 12.

As described above, the passive control layers 13U and 13L disposed on the principal surfaces of the substrates, and the plurality of active control layers 11 disposed in the intermediate layers are arranged so as to overlap each other (i.e., to be aligned with each other) in the orthogonal direction. By the above-described configuration, the phase control device 100 can control the phase of an electromagnetic wave radiated from the antenna 15 over a range of 0 to 360 degrees. That is, one three-dimensional unit 41 can change the phase of an electromagnetic wave received from the antenna 15 over the range of 0 to 360 degrees.

By the above-described configuration, the phase control device 100 according to this embodiment can provide a phase control device capable of controlling the phase of an electromagnetic wave in the Off state and actively controlling the phase in the On state while preventing a decrease in efficiency.

Fifth Embodiment

Figure 10:
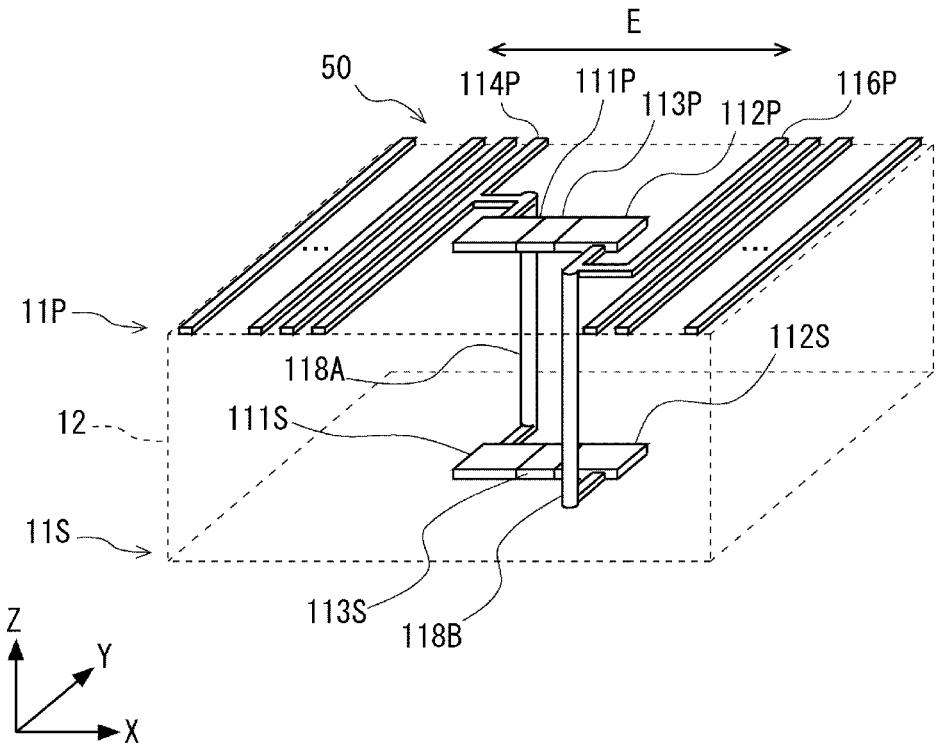
FIG. 10 illustrates an example of a three dimensional unit according to a fifth embodiment.

Next, a fifth embodiment is described with reference to FIG. 10. FIG. 10 shows an example of a three-dimensional unit according to the fifth embodiment. A phase control device 100 according to the fifth embodiment differs from the phase control device 100 according to the first embodiment because the phase control device 100 according to the fifth embodiment includes three-dimensional units 50 in place of the three-dimensional units 10. The embodiment is described hereinafter. However, explanations of components/structures that have already been described in the above-described example are omitted as appropriate.

The three-dimensional unit 50 shown in FIG. 10 includes an active control layer 11P, an active control layer 11S, a substrate 12, a via (e.g., a through hole filled with a conductive material) 118A, and a via 118B. Note that for the sake of easier understanding, the substrate 12 is indicated by broken lines in the three-dimensional unit shown in FIG. 10.

The active control layer 11P is disposed on the front principal surface of the substrate 12. The active control layer 11P includes a metal patch 111P, a metal patch 112P, and a modulator 113P. Further, the active control layer 11P includes a plurality of bias lines. A bias line 114P is connected to the metal patch 111P. A bias line 116P is connected to the metal patch 112P. Each of the plurality of bias lines included in the active control layer 11P extends in a direction perpendicular to a direction E, which is the direction of the electric field of the electromagnetic wave (i.e., in the Y-axis direction).

The active control layer 11S is disposed on the back principal surface of the substrate 12. Further, the active control layer 11S includes a metal patch 111S, a metal patch 112S, and a modulator 113S. Note that the active control layer 11S includes no bias line.

The via 118A is a conductive wire that penetrates the substrate 12 and extends in the Z-axis direction, which is the orthogonal direction. The via 118A connects the metal patch 111P of the active control layer 111S with the metal patch 111S of the active control layer 11S. That is, the metal patch 111S of the active control layer 11S is connected to the bias line 114P of the active control layer 11P through the via 118A.

Similarly to the via 118A, the via 118B is a conductive wire that penetrates the substrate 12 and extends in the Z-axis direction, which is the orthogonal direction. The via 118B connects the metal patch 112P of the active control layer 11P with the metal patch 112S of the active control layer 11S. That is, the metal patch 112S of the active control layer 11S is connected to the bias line 116P of the active control layer 11P through the via 118B.

As described above, the phase control device 100 according to the fifth embodiment includes, when it includes a plurality of active control layers 11 arranged in the orthogonal direction, a via(s) for connecting these plurality of active control layers 11 with each other.

Further, in the phase control device 100 according to this embodiment, it is possible to dispose, in the active control layer 11S of the three-dimensional unit 50, a bias line that is not connected to its own metal patch 111. That is, it is possible to prevent or minimize an increase in the area (i.e., the size) of the phase control device 100, which would otherwise be necessary due to the increase in the number of three-dimensional units, by arranging bias lines in a plurality of active control layers in a distributed manner by using vias.

By the above-described configuration, the phase control device 100 according to this embodiment can provide a phase control device capable of actively controlling the phase of an electromagnetic wave while preventing an increase in the number of bias lines and preventing a decrease in efficiency.

Modified Example of Fifth Embodiment

Next, a modified example of the fifth embodiment is described with reference to FIG. 11. A three-dimensional unit 51 according to the modified example of this embodiment includes a bias line layer including bias lines in an intermediate layer between substrates 12.

Figure 11:
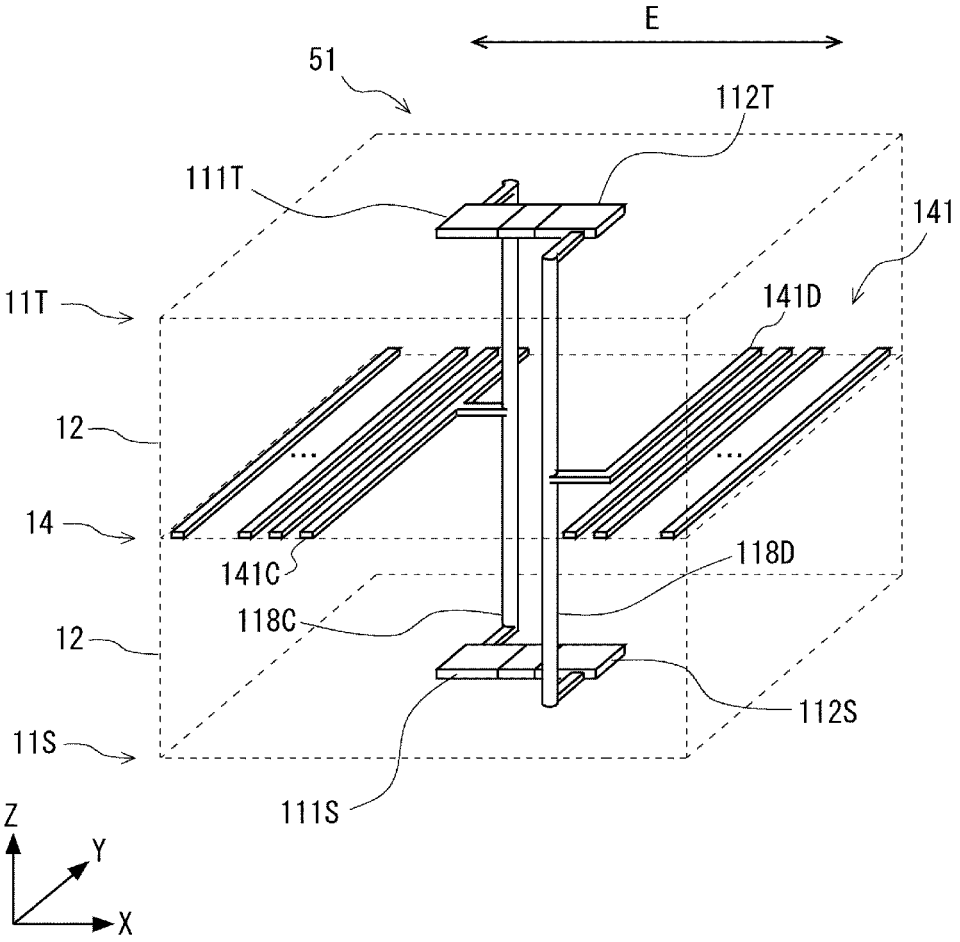
FIG. 11 illustrates an example of a three dimensional unit according to a modified example of the fifth embodiment.

FIG. 11 shows an example of a three-dimensional unit according to the modified example of the fifth embodiment. Note that for the sake of easier understanding, the substrates 12 are indicated by broken lines in the three-dimensional unit shown in FIG. 11. In the three-dimensional unit 51 shown in FIG. 11, an active control layer 11T, a substrate 12, a bias line layer 14, another substrate 12, and an active control layer 11S are stacked on one after another in this order from the Z-axis positive side toward the Z-axis negative side in the orthogonal direction (the Z-axis direction). That is, the three-dimensional unit 51 includes the active control layer 11T disposed on the front principal surface of the upper substrate 12, the passive control layer 13 disposed in an intermediate layer between the substrates 12, and the active control layer 11S disposed on the back principal surface of the lower substrate 12.

Further, the three-dimensional unit 51 includes a via 118C. The via 118 C connects a metal patch 111T of the active control layer 11T with a metal patch 111S of the active control layer 11S, and is connected to a bias line 141C of the bias line layer 14.

Further, the three-dimensional unit 51 includes a via 118D. The via 118D connects a metal patch 112T of the active control layer 11T with a metal patch 112S of the active control layer 11S, and is connected to a bias line 141D of the bias line layer 14.

The bias line layer 14 includes a plurality of bias lines. Each of the plurality of bias lines extends in a direction perpendicular to a direction E, which is the direction of the electric field of the electromagnetic wave (i.e., in the Y-axis direction). Further, each of the plurality of bias lines is connected to a metal patch related to one of three-dimensional units 10 included in the phase control device 100 through a via. For example, in the three-dimensional unit 51 shown in FIG. 11, the bias line 141C is connected to the metal patches 111T and 111S through the via 118C. Similarly, the bias line 141D is connected to the metal patches 112T and 112S through the via 118D.

By the above-described configuration, it is possible to configure the active control layer 11 so that it includes no bias line. When the number of three-dimensional units in the phase control device 100 is increased, the number of bias lines also increases. Therefore, if the bias lines are arranged on the same surface (e.g., in the same layer), it is necessary to increase the size of the principal surfaces of the three-dimensional units to secure the area where the bias lines are arranged. However, by providing the bias line layer 14 as shown in the modified example of this embodiment, it is possible to prevent or minimize the increase in the size of the principal surfaces in the phase control device 100, which would otherwise be necessary due to the increase in the number of bias lines. Note that the number of bias line layers 14 is not limited to one as shown in FIG. 11. That is, a plurality of bias line layers 14 may be provided.

By the above-described configuration, the phase control device 100 according to this embodiment can provide a phase control device capable of actively controlling the phase of an electromagnetic wave while preventing an increase in the area (i.e., the size) and preventing a decrease in efficiency.

Note that the phase control device 100 according to the above-described embodiments described can be applied to a communication device including a signal transmitting/receiving circuit. That is, the communication device can adopt a configuration including, at least, one of the above-described phase control devices 100, an antenna 15, and a communication transmitting/receiving circuit that controls the phase control device 100 and the antenna 15. In this way, the embodiment according to the present disclosure can provide a communication device that actively controls the phase of electromagnetic waves while preventing or minimizing a decrease in efficiency.

Note that the present disclosure is not limited to the above-described embodiments and can be modified as appropriate without departing from the scope and spirit of the disclosure. For example, the vias and the bias line layer shown in the fifth embodiment can be suitably combined with any of the first to fourth embodiments.

REFERENCE SIGNS LIST

10, 20, 21, 30, 31, 40, 41, 50, 51 THREE-DIMENSIONAL UNIT
11 ACTIVE CONTROL LAYER
12 SUBSTRATE
13 PASSIVE CONTROL LAYER
14 BIAS LINE LAYER
15 ANTENNA
100 PHASE CONTROL DEVICE
111, 112 METAL PATCH
113 MODULATOR
114, 116, 141 BIAS LINE
115, 117 CONDUCTIVE WIRE
118 VIA
131 METAL FRAME
132 METAL PATCH

What is claimed is:

1. A phase control device comprising:

a two-dimensional array of three-dimensional units and configured to shift a phase of an electromagnetic wave passing through the three-dimensional units, wherein each three-dimensional unit includes a substrate and an active control layer, the active control layer including two metal-patches and a modulator disposed between the two metal-patches and connected to each of the two metal-patches, and wherein the substrate or the active control layer includes at least one bias line connected to one of the two metal-patches and extending in a direction perpendicular to a direction of an electric field of the electromagnetic wave;

wherein the three-dimensional unit includes the active control layer on each of principal surfaces on front and back sides of the substrate so that they overlap each other in an orthogonal direction orthogonal to the principal surface, wherein the three-dimensional unit further includes a passive control layer in an intermediate layer of the substrate, wherein the passive control layer includes;

a flat metal frame including a hole; and a metal patch surrounded by the metal frame in the hole of the metal frame, and wherein the active control layer and the passive control layer are arranged so as to overlap each other in the orthogonal direction.

2. The phase control device according to claim 1, wherein the three-dimensional unit further includes at least one active control layer in an intermediate layer of the substrate, and the active control layers provided on the principal surface and the intermediate layer are arranged so as to overlap each other in the orthogonal direction.

3. The phase control device according to claim 1, wherein the three-dimensional unit further includes at least one active control layers in an intermediate layer of the substrate, and further includes a passive control layer on each of principal surfaces on front and back sides of the substrate, wherein the passive control layer includes a flat metal frame including a hole, and a metal patch surrounded by the metal frame in the hole of the metal frame, and wherein the passive control layer and the active control layer are arranged so as to overlap each other in the orthogonal direction.

4. The phase control device according to claim 1, wherein when the three-dimensional unit includes a plurality of active control layers, the three-dimensional unit includes at least one via extending in the orthogonal direction and connecting the plurality of the active control layers with each other.

5. The phase control device according to claim 1, wherein the three-dimensional unit further includes a bias line layer including at least one bias line in an intermediate layer of the substrate.

6. The phase control device according to claim 1, wherein the modulator is a PIN diode.

7. A communication device comprising:

the phase control device according to claim 1; and a signal transmission/reception circuit configured to transmit and receive a signal via the phase control device.

* * * * *